US007794197B2

(12) United States Patent
Thompson et al.

(10) Patent No.: US 7,794,197 B2
(45) Date of Patent: Sep. 14, 2010

(54) AEROFOIL BLADES WITH IMPROVED IMPACT RESISTANCE

(75) Inventors: Ewan F Thompson, Derby (GB); Simon Read, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 11/484,728

(22) Filed: Jul. 12, 2006

(65) Prior Publication Data

US 2007/0041842 A1 Feb. 22, 2007

(30) Foreign Application Priority Data

Aug. 4, 2005 (GB) ..... 0516036.1

(51) Int. Cl.
*F01D 5/14* (2006.01)

(52) U.S. Cl. ..... 415/9; 416/2; 416/229 A; 416/230; 416/233; 416/241 A

(58) Field of Classification Search ..... 415/9, 415/200; 416/2, 229 R, 229 A, 230, 232–233, 416/241 A See application file for complete search history.

(56) References Cited

U.S. PATENT DOCUMENTS

| | | | | |
|---|---|---|---|---|
| 2,919,889 | A * | 1/1960 | Rubel | 416/230 |
| 2,920,868 | A * | 1/1960 | Ackerman et al. | 416/230 |
| 3,032,317 | A * | 5/1962 | Frank | 416/230 |
| 3,695,778 | A * | 10/1972 | Taylor | 416/233 |
| 4,643,647 | A * | 2/1987 | Perry | 416/230 |
| 5,295,789 | A * | 3/1994 | Daguet | 416/241 A |
| 5,439,354 | A | 8/1995 | Hansen | |
| 5,584,660 | A | 12/1996 | Carter | |
| 5,720,597 | A * | 2/1998 | Wang et al. | 416/229 A |
| 5,839,882 | A | 11/1998 | Finn | |
| 7,316,502 | B2 * | 1/2008 | Freeman | 416/241 A |
| 2004/0151592 | A1 * | 8/2004 | Schreiber | 416/231 R |

FOREIGN PATENT DOCUMENTS

| | | | |
|---|---|---|---|
| EP | 764764 | A | 2/1997 |
| EP | 902165 | A | 3/1999 |
| EP | 926312 | A2 | 6/1999 |
| EP | 926312 | A3 | 6/1999 |
| EP | 1152123 | A | 10/2003 |
| EP | 1557532 | A | 7/2005 |

* cited by examiner

*Primary Examiner*—Christopher Verdier
(74) *Attorney, Agent, or Firm*—Jeffrey S. Melcher; Manelli Denison & Selter PLLC

(57) ABSTRACT

An aerofoil blade for a gas turbine engine, the blade having a metallic core defining a number of cavities that contain a foamed material. The cavities are shaped such that the force of an impact on one surface of the blade is dissipated through the foam and transmitted to the metallic core. A fibrous internal containment device allows the blade to fragment progressively thereby spreading the load imparted by the blade to a casing should the blade fragment upon impact.

19 Claims, 6 Drawing Sheets

AEROFOIL BLADES WITH IMPROVED IMPACT RESISTANCE

FIELD OF THE INVENTION

This invention concerns gas turbines, and more particularly, gas turbine blades.

BACKGROUND OF THE INVENTION

Aerofoil blades, such as fan blades for ducted fan gas turbine engines and propellers for turboprop gas turbine engines are conventionally either of a solid or composite structure.

A solid structure, typically of metal, is advantageous in terms of blade integrity and cost, but is not conducive with weight reduction and consequent improvements to operating efficiency.

It is also known to provide lighter, composite blades that have both solid metallic portions and foamed metallic portions. Whilst these have a certain integrity to impact from foreign debris ingested by the engine, the blades of the prior art still lack robustness.

SUMMARY OF THE INVENTION

It is an object of the present invention to seek to provide an aerofoil blade with better resistance to impact.

According to the present invention there is provided a blade for a gas turbine comprising:

a root, an aerofoil extending radially therefrom, the aerofoil having a leading edge, a trailing edge, a pressure side and a suction side;

the aerofoil further comprising a solid portion having ribs, the ribs defining cavities therebetween that extend substantially between the pressure side and the suction side, the cavities having an arrangement such that, upon an impact to the blade on the pressure side, generated loads are transferred from the cavity to an adjacent rib.

The ribs preferably extend chordwise along the blade generally between the leading edge and the trailing edge. The radial loads on the blade are preferably taken by the leading and trailing edge, with the ribs being arranged and orientated such that the blade is stiffened.

The leading edge, trailing edge and ribs preferably make up the solid portion of the aerofoil.

Preferably the ribs have a thickness in the radial direction that varies as the rib extends between the pressure surface and the suction surface. The thickness of the rib in the radial direction may reduce and then increase as the rib extends between the pressure surface and the suction surface. The thickness of the rib in the radial direction may be greater close to the suction surface than that close to the pressure surface.

Preferably the cavities contain material having a lower density than that of the solid portion. The lower density material is preferably a foamed material that abuts the ribs such that the foamed material is compressed against the ribs when the blade is subjected to an impact.

Preferably the aerofoil further comprises a wrap of a composite material encasing the solid portion and the cavities. Preferably at least one wall of the cavities is provided by a composite wrap. The lower density material may abut the composite material at the suction side of the aerofoil, and may also abut the composite material at the pressure side of the aerofoil.

The blade may comprise internal containment means, which may be an elongate material selected from the group comprising fibres of para-aramid fibers which are available under the trade name "Kevlar" from Du Pont, synthetic fibers based on ultra high molecular weight polyethylene which are available under the trade name "Spectra" from Honeywell, carbon, or metallic wires or tape.

The internal containment device may be attached at the root of the blade and at least one other point along the radial length of the blade. The at least one other point may be a rib. Preferably the internal containment means is non-supporting relative to the blade under normal operating conditions.

The internal containment device may be arranged within the blade to progressively fail upon the application of an impact to the blade. The progressive failure may manifest itself as progressive breaking of ribs and/or the elongate material.

The blade may be incorporated within a gas turbine engine.

BRIEF DESCRIPTION OF THE DRAWINGS

Embodiments of the present invention will now be described by way of example only and with reference to the accompanying drawings, in which:—

DETAILED DESCRIPTION OF THE INVENTION

Figure 1:
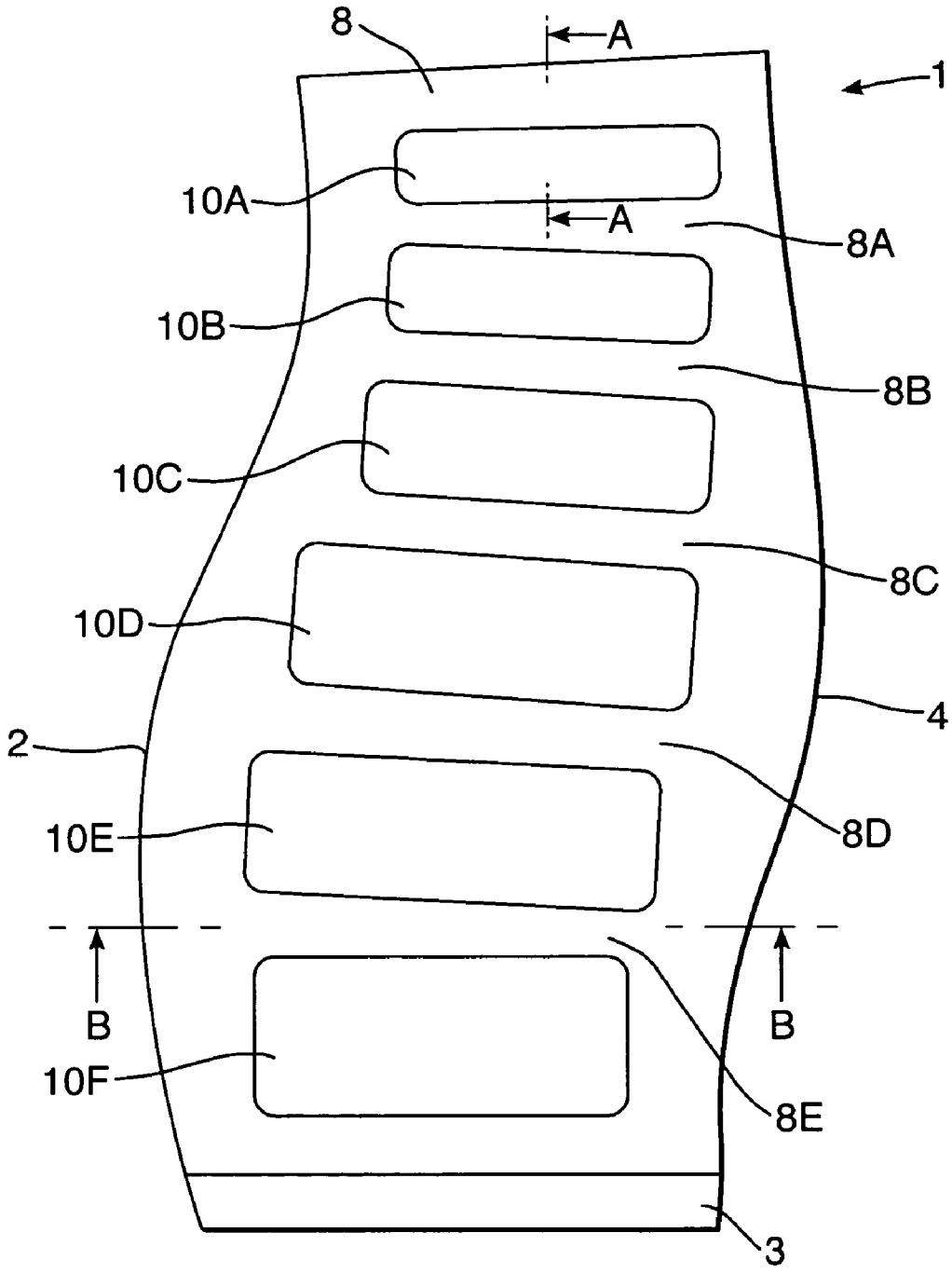
FIG. 1 is a view of an aerofoil of a blade of the present invention

FIG. 1 depicts an aerofoil according to the present invention. The aerofoil has a leading edge 2, a trailing edge 4 and, with reference to FIG. 2, a pressure surface 7 and a suction surface 6.

The aerofoil has a titanium metal core 8 that has a number of ribs 8*a* to 8*e* that extend chordwise between the leading and trailing edges. Radial loads are taken by the leading and trailing edges and the ribs serve to stiffen the blade and resist the effects of foreign object damage, or bird strike.

Between the ribs 8*a* to 3*e* are formed a number of cavities 10*a* to 10*f*. The structure of the blade is formed either by providing a blade and machining it to form the cavities and ribs, or through a powder metallurgy process, or some other nett shape forming process.

The cavities 10*a* to 10*f* contain a material having a lower density than the ribs. The material is a metallic foam or sponge, or even a polymeric foam or a composite material. The material provides strength to resist crushing loads.

The cavities are shaped such that a load applied to the pressure side of the aerofoil will serve to force the foam contained therein into closer contact with the ribs. Beneficially, this serves to transmit loads to the latter.

Figure 2:
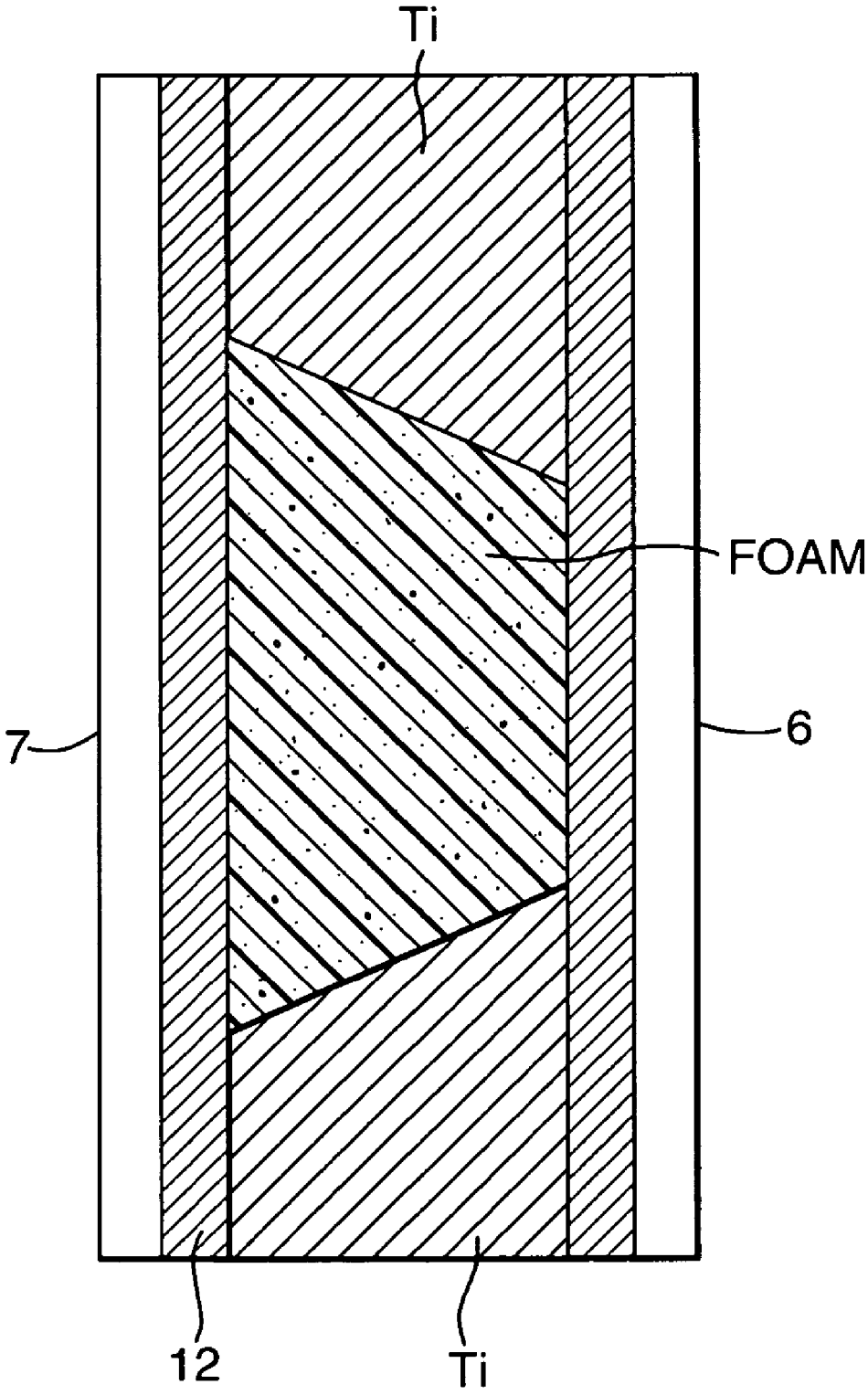
FIG. 2 is a view of the aerofoil of the blade of FIG. 1 taken along line A-A of FIG. 1
Figure 3:
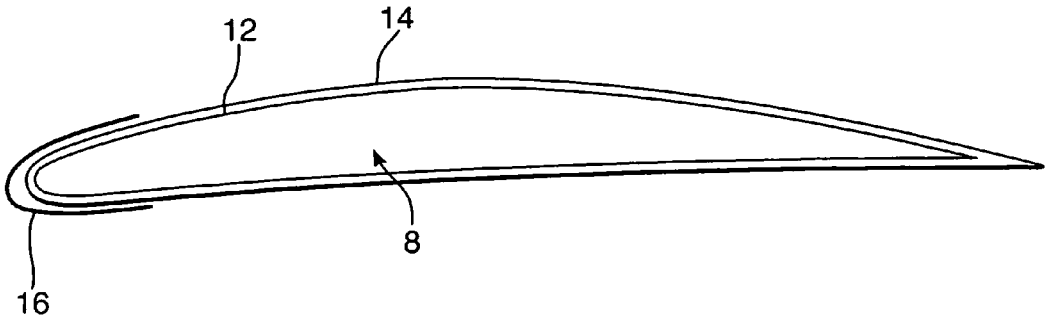
FIG. 3 is a view of the aerofoil of the blade of FIG. 1 taken along line B-B of FIG. 1
Figure 4:
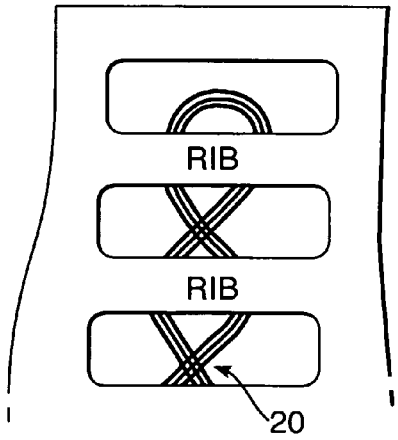
FIG. 4 is a view of part of an internal containment device according to the present invention.

In the preferred structure, shown in FIG. 2, and which is a section taken along A-A of FIG. 1, the cavities taper from the pressure side 7 towards the suction side 6. The foam is attached to the ribs through the use of an adhesive.

In an alternative structure the cavity may taper, from a central point, towards the pressure surface and to the the suction surface. The bi-directional taper serves to lock the foam within the cavity without the use of an adhesive.

Preferably, the foam is injected as a liquid and allowed to harden in-situ.

A layer of visco-elastic damping material 12 is provided over the surface of the ribs and foam material. This may extend over the entire surface of the aerofoil, or over the surface of the foam and a portion of the metal core. The visco-elastic material may be an adhesive that serves to help bond the foam material to the metal core.

A wrap of carbon fibre composite material 14 covers the aerofoil and the entire aerodynamic surface of the blade. The composite provides a smooth finish and constrains the damping material. Whilst it does not carry major loads it can resist minor impacts and controls vibration frequencies—particularly in a torsional mode.

The composite serves to protect the metal core from minor damage and serves to give a well controlled aerodynamic surface.

A metallic shield 16 is placed at the leading edge to protect against erosion and minor impact damage. The remaining surface is protected by the same or another metallic or polymeric coating.

Figure 5:
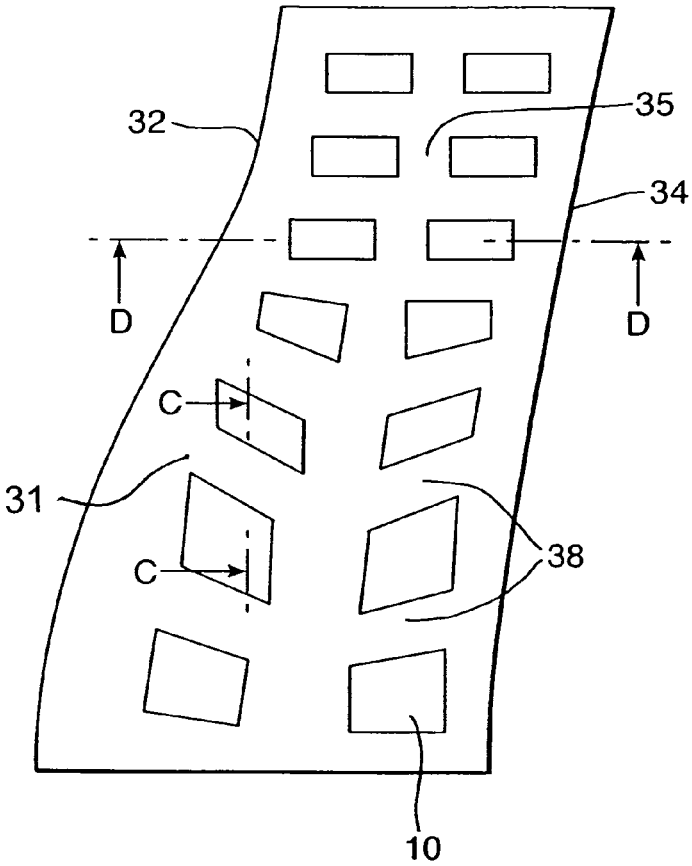
FIG. 5 is a view of an aerofoil blade of a second embodiment of the present invention.
Figure 6:
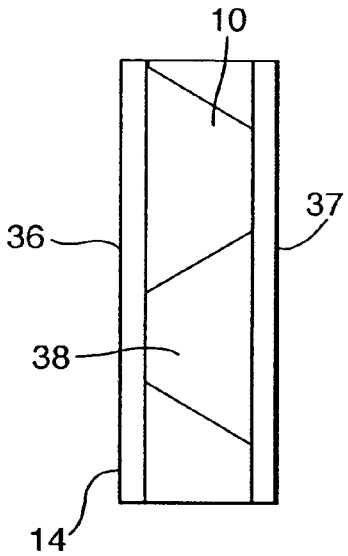
FIG. 6 is a view of the aerofoil of the blade of FIG. 5 taken along line C-C of FIG. 5
Figure 7:
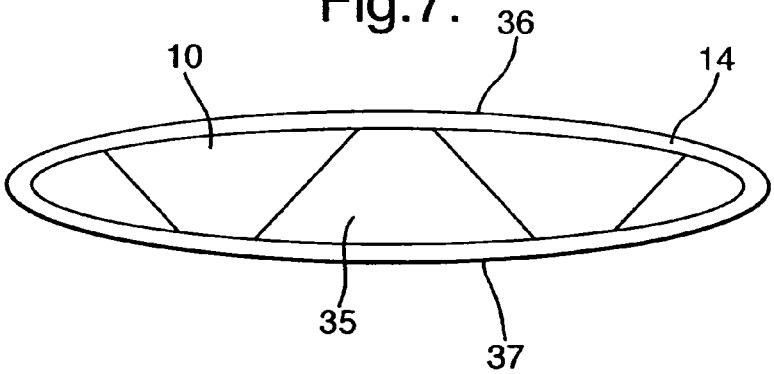
FIG. 7 is a view of the aerofoil of the blade of FIG. 5 taken along line D-D of FIG. 5

FIG. 5, is a fan blade having an alternative arrangement of ribs. The blade has a root portion (not shown) and an aerofoil portion 31. The aerofoil has a leading edge 32, a trailing edge 34 and, with reference to FIG. 6, which is a view of the blade of FIG. 5 taken along line C-C and 7, which is a view of the blade of FIG. 5 taken along line D-D, a pressure surface 36 and a suction surface 37.

The leading and trailing edges and ribs are formed of solid titanium and further structural support is provided by a radial mast 35 that supports the ribs 38. The ribs, in this embodiment, extend chordwise at the tip of the aerofoil but at an angle to the chord towards the root.

In this arrangement the distribution of the ribs serve to take both running loads in use and impact loads.

The aerofoil portion is wrapped with a composite that bounds the cavities at the pressure and suction flanks. The cavities are filled with a material of a lower density than that of the titanium, thereby reducing the weight of the blade over one that is fully solid. The lower density material is a metallic foam.

Within the blade, wrapped around the metallic ribs there is provided a fibrous containment device. The fibres, or tapes of metal or Kevlar are attached to the root and of the blade and then at other points along the radial length of the blade.

If debris is ingested into a gas turbine engine it generally strikes the fan and in particular a region of the pressure surface of the blades close to the leading edge. Other areas of the pressure surface may also be impacted.

If the debris is small the erosion shield and composite layer may be sufficient to resist the debris. For larger debris, such as in the situation where a bird is ingested into the engine the impact load may be transmitted through the composite layer to the foam filled cavities.

The impact load is spread by the foam which, as it is compressed, is forced into contact with the ribs. This has the effect of transmitting the loads to the ribs.

In some situations the debris is so large that the blade fragments upon impact. For a fan there is a requirement that the fragmented blade must be contained within the fan casing.

Figure 8:
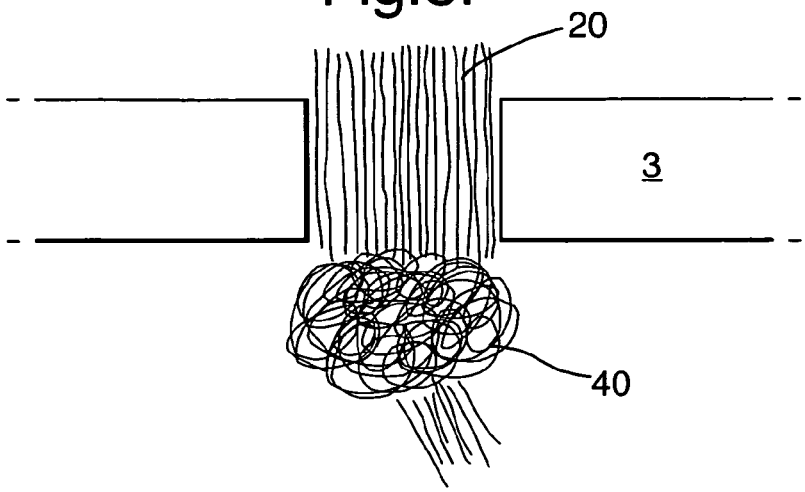
FIG. 8 depicts a first method of attaching an internal containment means to the blade

Through the fibrous containment device it is possible to absorb some of the energy of the fragmenting blade. The fibres 20 having diameters of between 1 to 10 mm are attached at the root 3 of the blade by a number of possible methods. In a first method, described with reference to FIG. 8, a radial hole is drilled or otherwise formed in the root and the fibres passed through the holes and knotted 40 to prevent the fibre being pulled through in a radially outward direction should the blade fragment. This technique is of particular use where the fibres are non-metallic.

Figure 9:
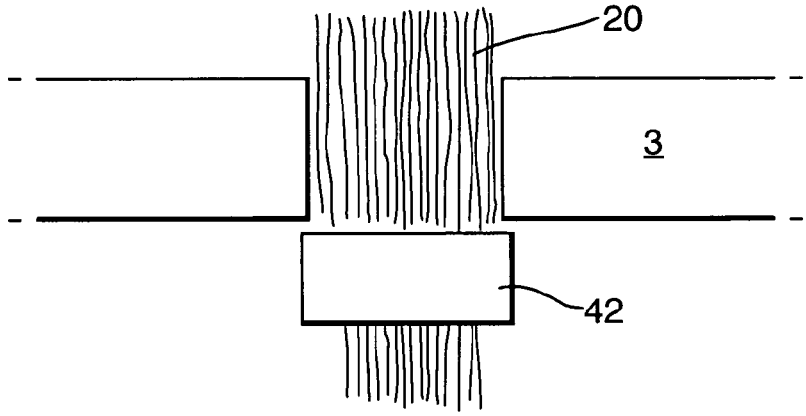
FIG. 9 depicts a second method of attaching an internal containment means to the blade

If the fibres are metallic, or it is undesirable to put a knot in the fibres an alternative, depicted in FIG. 9, provides a sleeve 42 crimped on the fibres.

Figure 10:
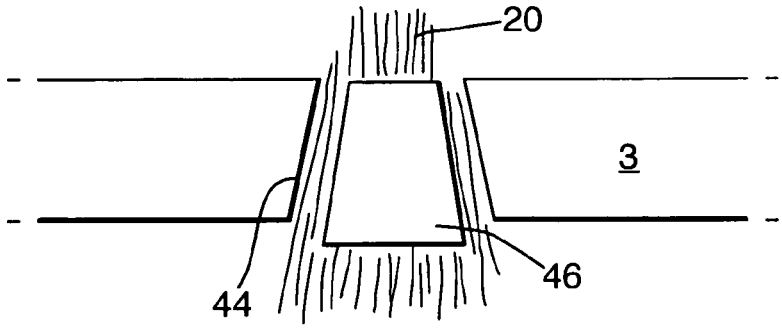
FIG. 10 depicts a third method of attaching an internal containment means to the blade.

A further alternative, depicted in FIG. 10, is to provide a conical hole 44 in the root portion of the blade and to insert a cone shaped wedge 46 that traps the fibres against the inner surface of each of the holes.

Alternatively the fibres may be bonded to the root portion using an adhesive or, where the fibres are metallic, using diffusion bonding.

The fibres are secured to other features along the length of the blade, such as the metallic ribs. The fibres are secured using similar techniques as adopted for the root region. For some embodiments it is not necessary to secure the fibres as they pass each rib—securing the fibres at the tip and root is sufficient. A criss-cross pattern of fibres is often advantageous to induce greater friction between the fibres and ribs, which better controls the radial movement during blade break-up.

A plurality of fibres or tows of fibres may be provided with the slack in each fibre or fibre tow being different to give progressive restraint. As the blade fragments move radially outwards each fibre or fibre tow acts on the blade progressively.

Each fibre or fibre tow may have fibres of different materials or diameters to provide different functionality. In one embodiment a fibre tow allowing greater elongation and high strength for particle retention is included with a second fibre tow that has a high modulus of elasticity which stores and dissipates energy.

The energy of the blade during break-up may be further dissipated by wrapping the fibres round the foam and relying on the fibres crushing the foam to dissipate the energy.

Where the foam is within the cavities before the fibres are added the fibres are threaded through holes or slots in the foam that are preferably formed prior to insertion of the foam in the cavities. Alternatively the holes may be formed by a needle that draws the fibres.

The fibres may be placed in-situ before the foam is added to the cavities. The foam expands to enclose and encase the fibres.

Upon fragmentation the blade fragments move radially outwards and the fibres straighten and crush the foam, dissipating energy.

Figure 11:
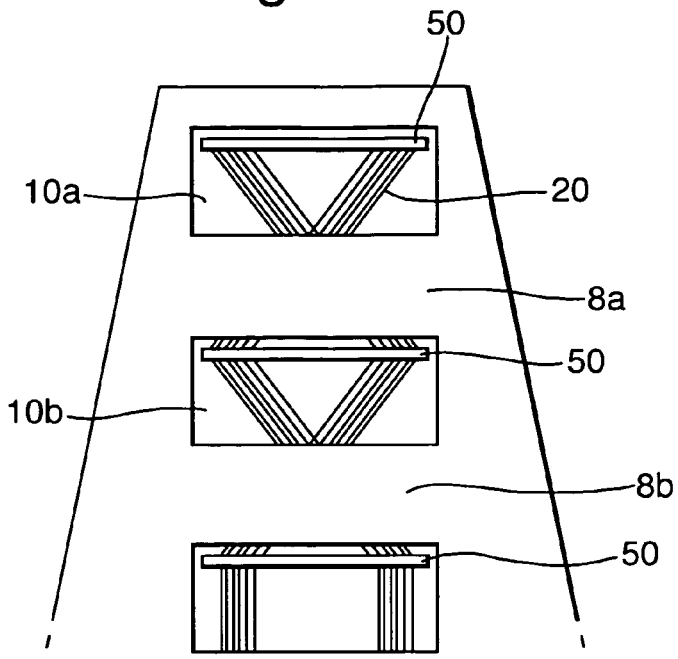
FIG. 11 depicts plates located to increase the crushing of the foam

Energy dissipation may be further increased by attaching plates 50 to the fibres, which increase the crushing of the foam as shown in FIG. 11. The plates are attached to the fibres using a method similar to those described above with joining the fibres to the roots. The plates have a higher strength than the crushing strength of the foam and are arranged on the fibres such that as the blade fragments move radially outwards, the plates tend to be held back by the fibres. This will then cause the regions of foam radially inboard of each plate to be crushed. In the simplest embodiment there is one plate located just radially inboard of each rib. In alternative embodiments there are two or more plates equally spaced across the radial length of the cavity.

The ribs break at different loads such that their progressive breaking absorbs energy at different timings. The fibres are stronger than the ribs, which may be deliberately weakened through the provision of local grooves in the regions where the fibres pass around or through the ribs.

Figure 12:
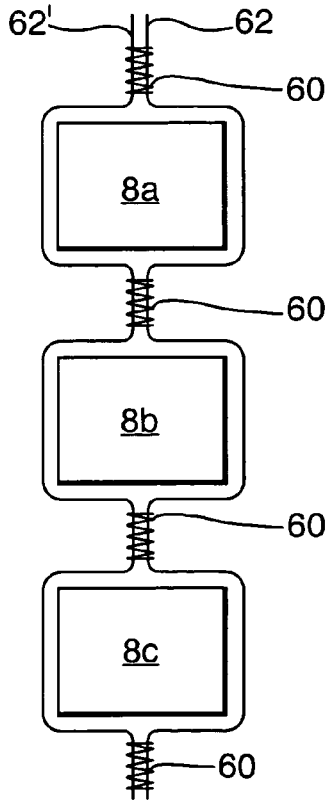
FIG. 12 depicts stitching of fibres to secure them at intermediate points along the length of the blade.

In a further embodiment metallic pins are provided that snap in a progressive manner. The pins are threaded through splayed regions in the fibres, or knots or sleeves crimped onto the fibres retain the pins. The pins are cylindrical and notches are used to induce the pins to break in a controlled manner.

Where the fibres are arranged in a tape or rope they are preferably stitched around the ribs in a manner that produces progressive breaking. As shown in FIG. 12, the stitching 60 joins two or more tapes 62, 62' at local points located between each pair of ribs. As the ribs move radially outwards, relative to the tapes, the stitching is forced apart. Since the ribs and the fibres are stronger than the stitches 60 the stitches will progressively break, dissipating energy and slowing the outward movement of the blade.

When the blade is impacted the fibrous containment device limits the amount of blade that breaks off, the remaining portion remaining attached to the root by the fibres. Additionally, the fibres serve to slow the outwardly radial movement of the blade and this serves to spread the impact load over a wider region of the casing and serves to reduce the maximum impact load on the casing.

The internal containment device dissipates the energy in the lost blade and significantly reduces the peak load on the casing. The slowing of the blade travel spreads the impact area which reduces the peak stresses in the containment casing.

The effect of both these changes results in significant weight saving in the casing, which is the single heaviest engine component and savings running to several tens of pounds are possible. The weight saving gives lower engine cost and increases engine efficiency.

Various modifications may be made without departing from the scope of the invention.

For example, the metal core has been described as titanium. It will be appreciated that materials conventionally used for aerofoils may be used. For example, other metals or metal alloys may be substituted.

Additionally, the above described fibrous containment system absorbs some of the energy of a blade that has failed due to fatigue or some other limitation.

We claim:

1. A blade for a gas turbine comprising:

a root, an aerofoil extending radially therefrom, the aerofoil having an aerofoil tip, a leading edge, a trailing edge, a pressure side and a suction side;

the aerofoil further comprising ribs that are separated by cavities which extend substantially between the pressure side and the suction side;

the blade further comprising elongate internal containment means extending continuously between the root and the aerofoil tip and selected from the group comprising fibres of an aramid, ultra high molecular weight polyethylene, carbon fibres and metallic wires or tape for absorbing some of the energy of the blade should the blade fragment on impact, the containment means being attached to the root and to the tip, wherein the elongate internal containment means is further attached to at least one of the ribs between the root and the tip, wherein the internal containment means is non-supporting relative to the blade under normal operating conditions.

2. A blade according to claim 1, wherein the internal containment means is arranged to progressively fail upon the application of an impact to the blade.

3. A blade according to claim 2, wherein the progressive failure manifests as progressive breaking of ribs and/or the elongate internal containment means.

4. A blade according to claim 1, wherein the cavities contain foam arranged to be crushed by the internal containment means upon catastrophic failure of the blade.

5. A blade according to claim 4, wherein the elongate internal containment means is selected from the group comprising metallic wires or tape.

6. A blade according to claim 1, wherein the fibres are arranged in a plurality of tows, a first tow having high strength for particle retention and a second tow having a high modulus of elasticity to store and dissipate energy.

7. A blade according to claim 1, wherein the internal containment means is knotted, crimped or wrapped around the ribs.

8. A blade according to claim 1, wherein each rib has a thickness in the radial direction extending between the root and the tip that reduces and then increases as the rib extends between the pressure side and the suction side.

9. A blade according to claim 1, wherein at least one wall of each cavity is provided by a wrap of composite material.

10. A blade according to claim 1, wherein two walls of each cavity are provided by the wrap of composite material.

11. A blade according to claim 1, wherein a wrap of composite material encases the ribs and the cavities.

12. A gas turbine engine incorporating a blade as claimed in claim 1.

13. A blade for a gas turbine comprising:

a root, an aerofoil extending radially therefrom, the aerofoil having an aerofoil tip, a leading edge, a trailing edge, a pressure side and a suction side;

the aerofoil further comprising ribs that are separated by cavities which extend substantially between the pressure side and the suction side;

the blade further comprising elongate internal containment means selected from the group comprising metallic wires or tape for absorbing some of the energy of the blade should the blade fragment on impact, the containment means being attached to the root and to the tip, wherein the elongate internal containment means is further attached to at least one of the ribs between the root and the tip, wherein the internal containment means is non-supporting relative to the blade under normal operating conditions.

14. A blade according to claim 13, wherein the internal containment means is arranged to progressively fail upon the application of an impact to the blade.

15. A blade according to claim 14, wherein the progressive failure manifests as progressive breaking of ribs and/or the elongate internal containment means.

16. A blade according to claim 13, wherein each cavity contains foam arranged to be crushed by the internal containment means upon catastrophic failure of the blade.

17. A blade according to claim 13, wherein the internal containment means is knotted, crimped or wrapped around the ribs.

18. A blade according to claim 13, wherein the leading edge, the trailing edge and the ribs are formed of titanium wherein the ribs extend in a chordwise direction between the leading edge and trailing edge.

19. A blade according to claim 18, wherein each rib has a thickness in the radial direction extending between the root and the tip that reduces and then increases as the rib extends between the pressure side and the suction side.

* * * * *